United States Patent [19]

Hom

[11] Patent Number: 4,862,187

[45] Date of Patent: Aug. 29, 1989

[54] DUAL BAND FEEDHORN WITH TWO DIFFERENT DIPOLE SETS

[75] Inventor: Harvey K. Y. Hom, Santa Monica, Calif.

[73] Assignee: Microwave Components and Systems, Inc., Agoura Hills, Calif.

[21] Appl. No.: 261,321

[22] Filed: Oct. 24, 1988

[51] Int. Cl.[4] ..... H01Q 13/02

[52] U.S. Cl. ..... 343/786; 343/761; 343/797

[58] Field of Search ..... 343/762, 786, 772, 775, 343/761, 797, 727, 793

[56] References Cited

U.S. PATENT DOCUMENTS

| | | | |
|---|---|---|---|
| 3,803,617 | 4/1974 | Fletcher et al. | 343/786 |
| 4,309,709 | 1/1982 | Hill | 343/786 |
| 4,504,836 | 3/1985 | Seavey | 343/786 |
| 4,574,289 | 3/1986 | Henderson | 343/786 |
| 4,740,795 | 4/1988 | Seavey | 343/786 |
| 4,821,046 | 4/1989 | Wilkes | 343/786 |

*Primary Examiner*—J. Carroll
*Assistant Examiner*—Doris J. Johnson
*Attorney, Agent, or Firm*—Jack C. Munro

[57] ABSTRACT

A feedhorn for a satellite dish which is far more efficient picking up the transmitted microwave signal from a satellite so as to permit the satellite dish to be substantially decreased in physical size. The feedhorn is constructed to pick up either the C-Band or the Ku-Band, each in either the horizontally polarized mode or the vertically polarized mode. The feedhorn utilizes dipoles for picking up the microwave signal which are then transmitted by a coaxial cable to a printed circuit board assembly. The received signal from the printed circuit board assembly is then transmitted through a receiver. The selection of the particular band of frequency that is to be transmitted from the feedhorn and the selection of the horizontal mode or the vertical mode is to be accomplished by a remote actuator such as is commonly used with a conventional television receiver.

7 Claims, 2 Drawing Sheets

DUAL BAND FEEDHORN WITH TWO DIFFERENT DIPOLE SETS

BACKGROUND OF THE INVENTION

The field of this invention relates to antennas and more particularly to a feedhorn that is to be used to receive and transmit the downlink signal from a satellite to a receiver such as a television set.

Use of satellites in broadcasting of television programs is exceedingly common. The use of satellites constitute a much less expensive method of transmitting television programs as well as substantially increasing the fidelity of the transmission. Additionally, satellites make available a great many channels for sending out of television programs.

The use of a satellite dish antenna permits a single homeowner to get the television programs directly eliminating the need to pay a service fee to a local cable television company. Also, the individual homeowner has a big advantage in that he/she has a substantially increased selection over that what the local station chooses to rebroadcast.

A television's program trip by satellite starts at the uplink, where the program is put on the carrier. The carrier is one of a band of frequencies cluster around six gigaHertz, or six billion (6,000,000,000) cycles per second. This microwave frequency is chosen because, among other things, it can be focused into a narrow beam by dish antennas of practical size and because it penetrates quite well through moisture and dust in the atmosphere. Uplink antennas are usually thirty feet across which are a good balance between cost and efficiency.

The dish-shaped antenna, which are exceedingly familiar in conjunction with satellite signal transmission and satellite signal receiving, are really parabolic reflecting mirrors acting like the parabolic mirrors utilized in conjunction with search lights. The uplink antenna sends the signal out in a narrow beam because the signal must be sent to a particular satellite. The beam from the uplink must go in the right direction within about one-tenth of a degree.

Each satellite carries a plurality, of transponders with each transponder providing a complete separate electronic path from incoming signal to outgoing signal. Each transponder is tuned to one of the standard bands near six gigaHertz. Tuning the uplink signal to the right band, activates the desired transponder.

Each transponder has two modes, that is, a horizontally polarized signal and a vertically polarized signal. Thus, the program carrying ability of each transponder is doubled with each polarized signal capable of carrying a single television program. The more material the single satellite can carry, the less expensive the system.

Each transponder of the satellite converts a signal to one of many standard frequencies clustered around four gigaHertz for the downlink signal. This is referred to as the C-Band. Now satellites are being constructed to include a second band which is at a frequency much greater than the four gigaHertz of the C-Band. This second band being referred to as the Ku-Band. This Ku-Band is in the range of twelve gigaHertz.

The satellite transmits the downlink signal on a broad beam that covers a large area. Each receiver assembly on earth starts with a dish-shaped parabolic antenna that captures a segment of the energy being beamed down and focuses such into the receiving equipment. The larger this antenna, the more efficient the receiving of the energy. In the past, most home antennas have been in the range of nine to twelve feet for a good balance between cost and performance.

The size of these dish-shaped antennas (nine to twelve feet in diameter) is being judged by an increasing number of residential communities as being unattractive in appearance. Installation of such antennas is prohibited in such communities. Therefore, usage of these antennas are becoming limited to the rural communities. However, if the size of this antenna could be substantially diminished, then possibly the usage of these antennas would not be restricted within residential communities.

SUMMARY OF THE INVENTION

The primary objective of the present invention is to provide for a substantially improved feedhorn for a downlink antenna used for picking up of a satellite transmitted signal whereby the dish of the antenna can be constructed to be substantially smaller in size than was heretofore possible.

Another objective of the present invention is to construct a feedhorn which can be manufactured at a cost substantially less than conventional feedhorn manufacture.

The dual band feedhorn of the present invention utilizes two different sets of dipoles for the picking up of the downlink signal. The received signal is transmitted directly into a coaxial cable and then into a printed circuit board assembly. Between the printed circuit board assembly and the dipoles, there is included a coil within the cable to permit pivoting of the dipoles relative to the printed circuit boards so that the dipoles can be oriented to receive either the horizontal polarized mode of the signal or the vertical polarized mode of the signal. Associated with the dipoles is a divider plate whose function is to permit the reception of the desired mode while cancelling out the undesired mode. The printed circuit board assembly includes a switching assembly which is to be activatable remotely such as by the use of the remote of the conventional television receiver. The switching assembly provides for pivoting of the dipoles to receive either the horizontal polarized mode or the vertical polarized mode and also for selecting which band of frequencies is to be received, either the C-Band or the Ku-Band.

DETAILED DESCRIPTION OF THE SHOWN EMBODIMENT

Figure 1:
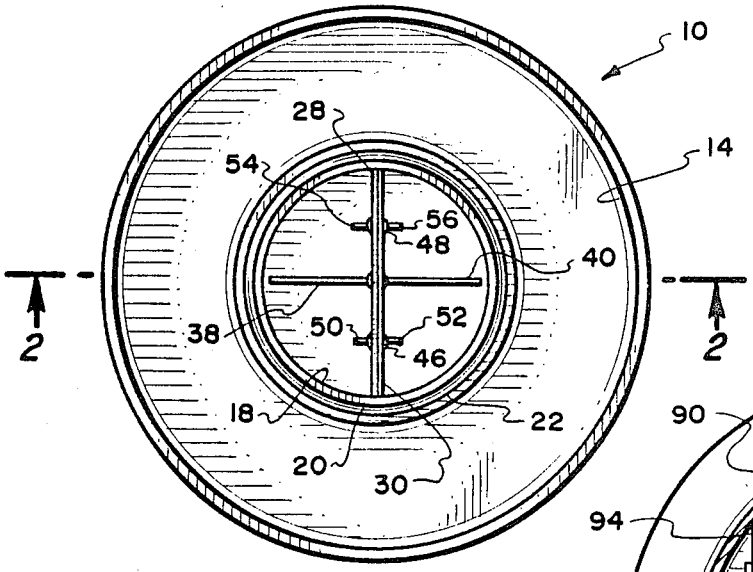
FIG. 1 is a top plan view of the throat area of the feedhorn of this invention.

Referring particularly to the drawings, there is shown the dual band feedhorn 10 of this invention. The largest in size part of the feedhorn 10 comprises a metallic housing 12. The outer end of the housing 12 is formed into an open annular recess 14. The recess 14 is for the purpose of facilitating collection of the energy of the microwave signal, represented by arrows 16 in FIG. 2, to be directed within the throat 18. The throat 18 is formed within a metallic cup 20. Cup 20 is mounted within a centrally located opening 22 formed within the housing 12. Located between the cup 20 and the wall of the opening 22 is a seal 24. The seal 24 is ring-shaped. The cup 20 is to be pivotable within the opening 22 with normal pivoting being limited to ninety degrees. However, in some instances, pivoting can be greater such as one hundred twenty degrees which is depicted generally by arrow 26 within FIG. 3.

Throat 18 at its outer end is open to the ambient. Mounted within the cup 20 across the throat 18, in essence dividing the throat 18 into two equal parts, is a divider plate 28. The ends of the divider plate 28 are to be fixedly mounted to the wall surface of the throat 18. The primary material of construction for the divider plate 28 will be sheet plastic. One of the surfaces of the divider plate 28 is to have permanently attached thereto a coating 30. Preferable material for the coating 30 would be titanium, although it is considered to be within the scope of this invention that other materials could be used such as an iron alloy of some particular composition. A desirable thickness of the coating would be two microns.

The important thing concerning the coating 30 is that it be electrically conductive and to have an electrical resistance of approximately fifty ohms per square centimeter. It has been found that this resistance value is quite effective in cancelling out the not desired polarized mode of the microwave signal represented by arrow 16. In other words, let it be assumed that arrow 16 represents the horizontal polarized mode of the signal and that horizontal polarized mode is being freely conducted within the throat 18. The vertically polarized mode would constitute waves whose amplitude is transverse to the amplitude of the horizontally polarized mode. This transverse orientation of the wave comes into contact with the divider plate 28 and hence the coating 30. Because of the resistance of the coating 30, the energy of the vertically polarized mode is absorbed. Since the amplitude of the horizontally polarized mode is running parallel to the coating 30, there is no interference and hence no dissipation of the energy. Hence, the vertically polarized mode does not interfere (create noise) with the pickup of the horizontally polarized mode thereby enhancing the reception of the signal. If the cup 20 is pivoted ninety degrees, the horizontally polarized mode would be absorbed with the vertically polarized mode now being received.

Figure 2:
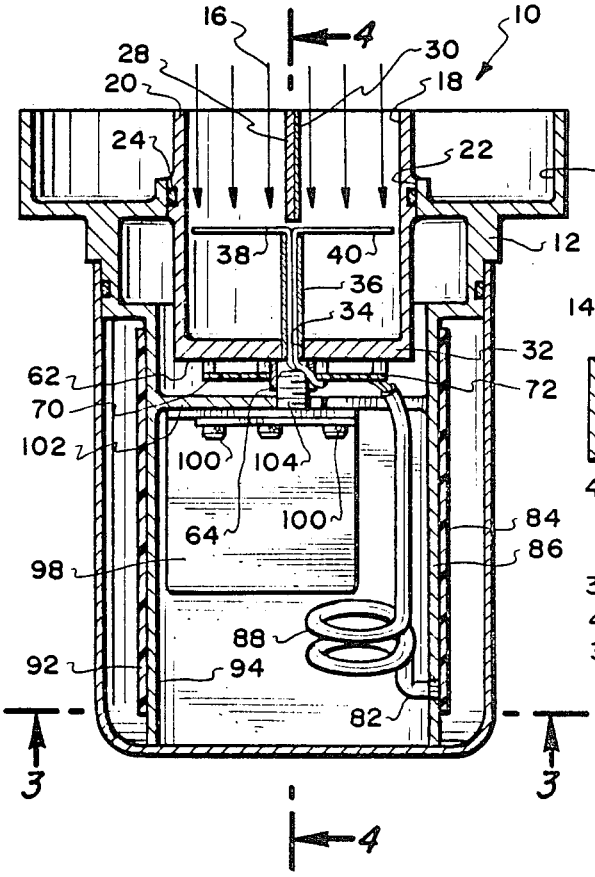
FIG. 2 is a cross-sectional view through the feedhorn taken along line 2—2 of FIG. 1.
Figure 4:
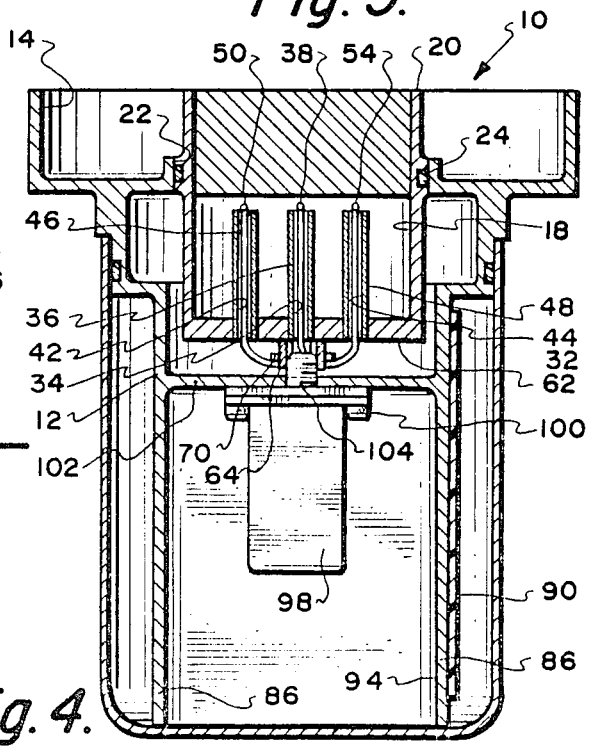
FIG. 4 is a longitudinal cross-sectional view through the feedhorn taken along line 4–4 of FIG. 2.

The cup 20 includes a bottom plate 32. Within this bottom plate 32 there is centrally located a hole 34. Within the hole 34 is mounted a coaxial cable 36. This cable 36 extends approximately one-half the depth of the throat 18 and is sufficiently rigid in and of itself to not require any additional support to remain in the established standing position shown in FIG. 2. Within the cable 36 is located a pair of electrical conductors 38 and 40. The conductors 38 and 40 comprise bare wire and are bent to be located in alignment with each other in opposite extending directions as shown in FIG. 2 of the drawings.

The overall, or combined length, of the conductors 38 and 40 is important. Antennas, which conductors 38 and 40 are functioning as, are subject to resonance. What is meant by resonance is that the antenna may be relatively insensitive to most of the frequencies of the microwave signal that is being received. But at a certain frequency range, the antenna is exceedingly sensitive. It is known that this sensitivity is in direct relation to the length of the wave of the signal it receives. For example, at four gigaHertz the wavelength is approximately 4.72 inches. Therefore, if the overall length of conductors 38 and 40 is 4.72 inches, the conductors 38 and 40 would be receptive to this particular wavelength. If it is not feasible to construct the conductors 38 and 40 to be of the length of 4.72 inches, if this length is one-half of the wavelength, that is 2.36 inches, a similar antenna efficiency will be obtained. Within the present invention, the preferable length for the conductors 38 and 40 would be the ½ wavelength or 2.36 inches.

Located on either side of the hole 34 are holes 42 and 44 formed within the plate 32. The center of the holes 32, 42 and 44 are all located on a diameter of the throat 18. Hole 42 is about equally spaced from hole 32 and the wall surface of the throat 18. In a similar manner, the hole 44 is about evenly spaced from the hole 34 and the wall surface of the throat 18.

Figure 5:
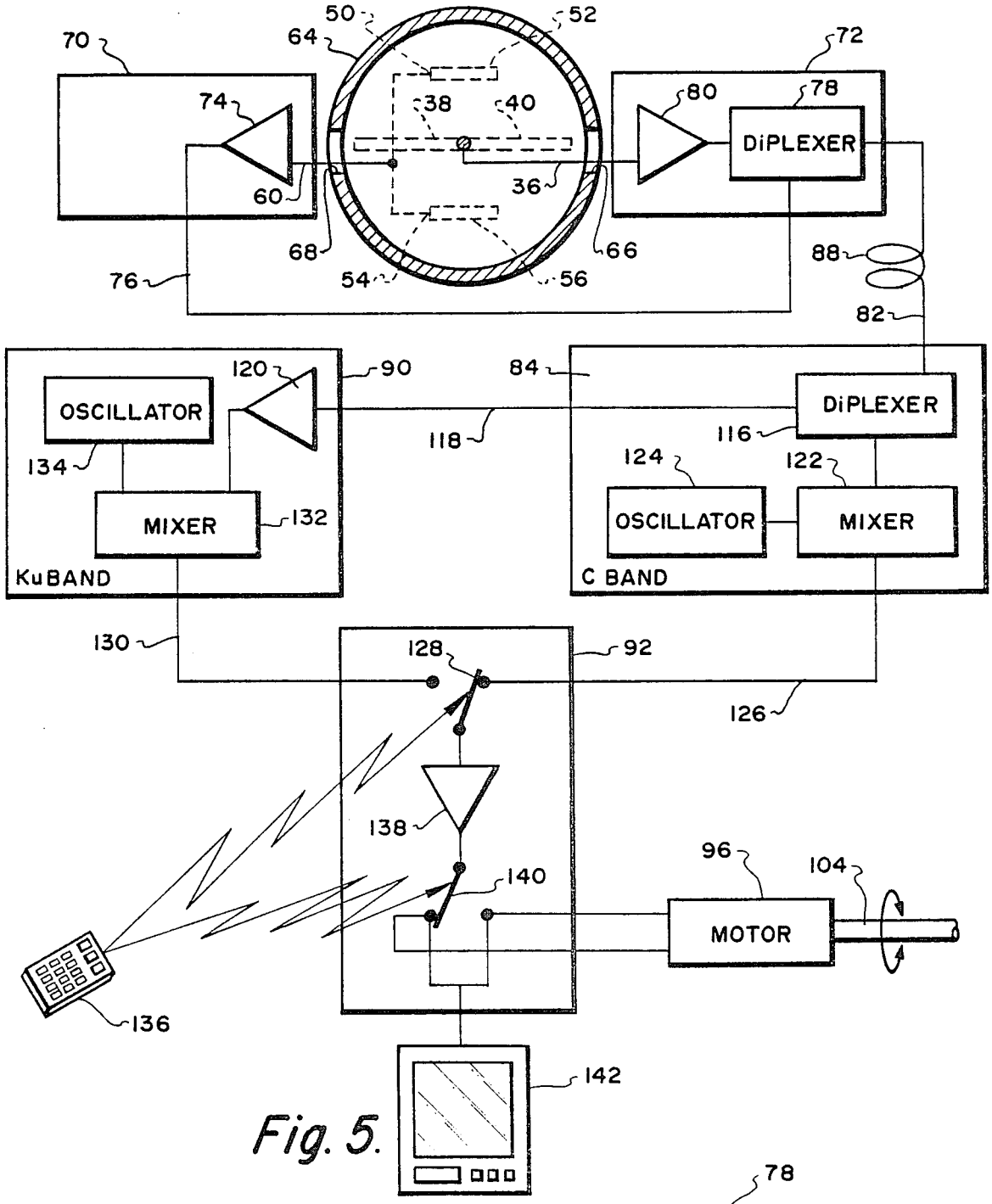
FIG. 5 is an electrical block diagram of the circuitry utilized in conjunction with the feedhorn of the present invention.

Fixedly mounted within the hole 42 is a coaxial cable 46. A similar coaxial cable 48 is fixedly mounted within the hole 44. Coaxial cables 46 and 48 are of the same height and also the same height as coaxial cable 36. Cable 46 includes a pair of conductors 50 and 52 with cable 48 including a pair of conductors 54 and 56. Conductors 50 and 52 are in alignment and are of the same length and are parallel to conductors 38 and 40. The conductors 54 and 56 are also similarly oriented. The combined overall length of the conductors 50 and 52 is equal to the combined overall length of the conductors 54 and 56 with this length being about three-quarters of an inch. This is equal to approximately one-half the wavelength of the wave that these dipoles are to be sensitive to which is about one and one-half inches. This wavelength is about twelve gigaHertz which is within what is termed the Ku-Band. These dipoles composed of conductors 50, 52, 54 and 56 are connected electrically connected together in series by conductor 60 which is schematically depicted in FIG. 5 of the drawings.

Fixedly mounted on the undersurface 62 of the plate 32 is a sleeve 64. This sleeve 64 includes diametrically spaced apart gaps 66 and 68. The conductor 60 is conducted exteriorly of the sleeve 64 through gap 68. In a similar manner the coaxial cable 36 is conducted through gap 66 exteriorly of the sleeve 64.

Mounted on the undersurface 62 of the plate 32 are a pair of printed circuit (pc) boards 70 and 72. Each of the boards 70 and 72 are of the same size and form in essence narrow strip-like members. Boards 70 and 72 are located diametrically opposite each other in reference to sleeve 64. Conductor 60 is mounted onto the board 70 and within the board 70 is located an amplifier 74. The output of the amplifier 74 is supplied to conductor 76 which extends exteriorly of the boards 70 and is connected electrically to a diplexer 78 formed within the board 72. The coaxial cable 36 connects to the board 72 and also connects to the diplexer 78 after being connected through an amplifier 80. Amplifiers 80 and 74 are normally of the same size, the preferable size being sixteen decibels (db).

The diplexer 78 provides for simultaneous transmission of both the Ku-Band and C-Band signals into a cable 82. This cable 82 connects with a pc board 84 which is mounted on a shell 86 of the housing 12. The cable 82 includes a coil 88 which is to function as a universal joint so as to not restrict the pivotal movement of the cup 20 relative to the housing 12. Cable 82 will be a coaxial cable and generally will be of a rigid construction. Therefore, the inclusion of some type of universal joint would be desirable and it is for this reason that the coil 88 is included.

Figure 3:
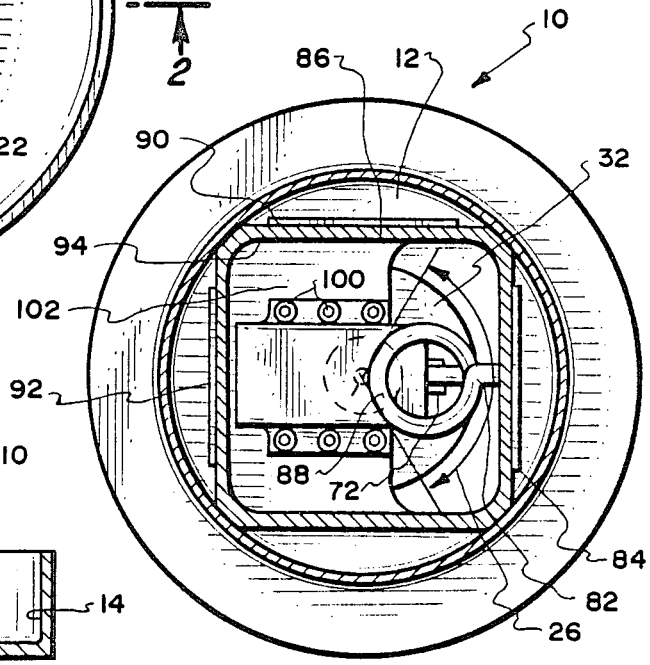
FIG. 3 is a bottom cross-sectional view through the feedhorn taken along line 3—3 of FIG. 2.

The cross-sectional configuration of the shell 86 as shown in FIG. 3 is substantially rectangular. The pc board 84 is mounted on one surface of the shell 86 with a second pc board 90 being mounted on another surface of the shell 86 and a third pc board 92 being mounted on a third wall of the shell 86. The fourth wall of the shell 86 does not have a pc board mounted thereon.

The interior portion of the shell 86 defines an interior chamber 94. Within this interior chamber 94 is mounted a motor 96. This motor 96 is encased within a motor housing 98. The motor housing 98 is mounted by bolts 100 to a wall 102. The motor 96 is to be electrically driven from a source (not shown). The motor 96 is to reversibly operate a motor shaft 104. The motor shaft 104 is fixedly connected to the sleeve 64. The sleeve 64 is movable relative to the wall 102. Operation of the motor 96 results in rotation of the shaft 104 and pivoting of the cup 20 within the housing 12.

Figure 6:
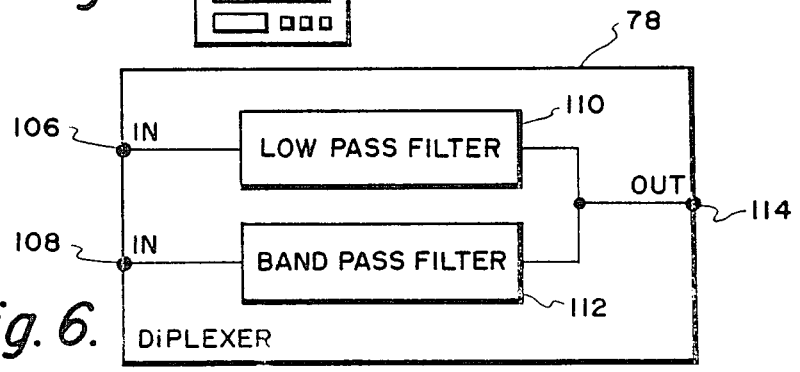
FIG. 6 is a block diagram of the circuitry of a diplexer which is utilized within the circuitry of the present invention.

Referring particularly to FIG. 5, the purpose of the diplexer 78 is to transmit both the Ku-Band and C-Band signals through one common transmission line which comprises the cable 82. Referring particularly to FIG. 6, the construction of the diplexer 78 is shown. The output of amplifier 80 is transmitted to junction 106. Conductor 76 is connected to junction 108. The signal from junction 106 is conducted through a three-section low-pass filter 110 which has low loss at C-Band frequencies and high attenuation at Ku-Band frequencies. From junction 108 the signal is transmitted through a three-section band pass filter 112. This band pass filter 112 has a low loss at Ku-Band frequencies and a high attenuation at C-Band frequencies. The outputs of filters 110 and 112 are joined at junction 114 and are propagated independently down the cable 82.

The output from the cable 82 is conducted into a diplexer 116 which is mounted on the pc board 84. The diplexer 116 is essentially identical to diplexer 78 with the exception that the input is supplied into junction 114 and the signal is separated into a Ku-Band signal and a C-Band signal. The Ku-Band signal is transmitted into conductor 118 and into a twenty-four decibel amplifier 120 mounted on the pc board 90. The C-Band output from the diplexer 116 is transmitted through conductor 120 to a down conversion mixer 122. Supplied into the down conversion mixer 122 is the output of a fundamental frequency oscillator 124. The oscillator 124 is to be driven by a positive voltage from a source (not shown). The output of the mixer 122 is transmitted into conductor 126 to a switch 128. Switch 128 is mounted on pc board 92. Also being supplied to switch 128 is Ku-Band signal through conductor 130 which receives its signal from a mixer 132 which is mounted on the pc board 90. The mixer 132 is also a down conversion mixer. Inputs to the mixer 132 constitute the output from the amplifier 120 and the output of fundamental frequency oscillator 134 which is basically identical to the oscillator 124. It is the function of the mixers 122 and 132 to lower the frequency down to about one gigaHertz within their respective conductors 126 and 130. In order to lower the frequency down to this level, it is necessary to input the signal from the oscillators 124 and 134 into their respective mixers 122 and 132.

Switch 128 is to be operated by remote actuator 136 by pushing of a particular selected button on the actuator 136 which causes the switch 128 to either connect with conductor 126 or conductor 130. If the switch 128 is connected with conductor 126, only the C-Band signal is being supplied through twenty-four decibel amplifier 138 mounted on the pc board 92. If the switch 128 is connected to conductor 130, only the Ku-Band signal is being transmitted to the amplifier 138.

The output from the amplifier 138 is transmitted to a switch 140. Switch 140 is mounted on the pc board 92. The switch 140 is to also be operated by remote 136. Switching mechanism within the remote 136 for operating switch 140 is different than the switching mechanism for the operating of the switch 128. In other words, the switch 140 is operated independently of the switch 128. Switch 140 is connected with motor 96 and motor 96 is to be electrically driven from a source of electrical energy (not shown). Location of switch 140 in one position will activate the motor 96 so as to orient the cup 20 to receive the horizontally polarized signal. Activating the switch 140 will result in motor 96 being operated to reversely rotate the shaft 104 to locate the cup 20 in a ninety degree displaced position so as to be receptive to the vertically polarized mode of the downlink signal from the satellite. It is to be understood that activating of the switch 140 again reverses the shaft 104 so that it goes back to the horizontally polarized mode of the downlink signal. Whatever position the switch 140 is in, the output is transmitted to a receiver 142 such as a conventional television set.

What is claimed is:

1. A dual band feedhorn comprising:

a housing;

a cup mounted within said housing;

a throat formed within said cup, said throat being opened to the ambient and adapted to receive a microwave signal, said cup being pivotable relative to said housing;

a dipole assembly fixedly mounted to said cup and located within said throat, said dipole assembly for receiving the microwave signal;

a cable integrally connected to said dipole assembly, said cable comprising a continuous electrical conductor for transmitting the received microwave signal; and an electrical circuit board assembly mounted on said housing, said cable being connected to said electrical circuit board assembly, said electrical circuit board assembly including first switch means, said first switch means being remotely operated, operation of said first switch means causes pivoting of said cup, said electrical circuit board assembly being adapted to transmit the received microwave signal to a receiver.

2. The dual band feedhorn as defined in claim 1 wherein:

said cup including a divider plate mounted within said throat, said divider plate comprising a thin sheet material member, said divider plate being mounted within said throat dividing said throat into two substantially equal parts with each said part being open to the ambient, said divider plate being for the purpose of substantially eliminating unwanted polarized modes of signals thereby enhancing the reception of the desired polarized mode of signal.

3. The dual band feedhorn as defined in claim 2 wherein:

said divider plate including an electrically conductive coating having an electrical resistance of approximately fifty ohms per square centimeter.

4. The dual band feedhorn as defined in claim 1 wherein:

said dipole assembly comprising two different dipole sets, each said dipole set to be sensitive to a particular band of frequencies of the microwave signal.

5. The dual band feedhorn as defined in claim 1 wherein:

said electrical circuit board assembly including electrical circuitry for transmitting an output sensitive to a first band of frequencies and a second band of frequencies, second switch means included within said circuitry, said second switch means being operated remotely so that the output of said circuitry is either for said first band of frequencies or said second band of frequencies.

6. The dual band feedhorn as defined in claim 1 wherein:

a universal joint included within said cable, said universal joint permitting unrestricted pivoting of said cup relative to said housing.

7. The dual band feedhorn as defined in claim 6 wherein:

said universal joint comprising a coil.

* * * * *